US005557386A

United States Patent [19]

Meguro et al.

[11] Patent Number: 5,557,386

[45] Date of Patent: Sep. 17, 1996

[54] TONER RECOVERING DEVICE FOR ELECTROPHOTOGRAPHIC APPARATUS AND TONER RECOVERING FILTER FOR SAID TONER RECOVERING DEVICE

[75] Inventors: Yuuji Meguro; Shuho Yokokawa; Isao Nakajima; Tsukasa Onose; Hiroshi Ueno, all of Ibaraki, Japan

[73] Assignee: Hitachi Koki Co., Ltd., Tokyo, Japan

[21] Appl. No.: 558,857

[22] Filed: Nov. 16, 1995

[30] Foreign Application Priority Data

Nov. 18, 1994 [JP] Japan ..... 6-285426
Sep. 29, 1995 [JP] Japan ..... 7-252506

[51] Int. Cl.[6] ..... G03G 21/00

[52] U.S. Cl. ..... 355/298; 209/710; 209/305; 209/31; 55/385.1; 55/510

[58] Field of Search ..... 355/298, 206, 355/304; 209/710, 305, 31, 30, 36, 37; 55/337, 510, 327, 385.1

[56] References Cited

U.S. PATENT DOCUMENTS 5,439,506 8/1995 Chen et al. ..... 55/385.1

*Primary Examiner*—Joan H. Pendegrass
*Assistant Examiner*—Quana Grainger
*Attorney, Agent, or Firm*—Sughrue, Mion, Zinn, MacPeak & Seas

[57] ABSTRACT

A toner recovering device for an electrophotographic apparatus, which includes: a dust collector connected to a device for cleaning untransferred toner remaining on a photosensitive body; a toner recovering filter having an inlet port for introducing an air-toner mixture from the dust collector side and an exhaust port for filtering the air-toner mixture and discharging the air from which the toner has been removed; a filter mounting section for mounting the toner recovering filter; a joint mechanism having a joint and a hose member, one end of the hose member capable of being connected to the dust collector and other end thereof being joint, the joint being disposed at the inlet port, the joint mechanism being arranged in the filter mounting section in such a manner as to be opened and closed; a detector for sensing that the toner recovering filter has been mounted or not onto the filter mounting section; and a pulling member for coupling the inlet port of the toner recovering filter to the joint in synchronism with an operation of mounting the toner recovering filter onto the filter mounting section.

4 Claims, 3 Drawing Sheets

TONER RECOVERING DEVICE FOR ELECTROPHOTOGRAPHIC APPARATUS AND TONER RECOVERING FILTER FOR SAID TONER RECOVERING DEVICE

BACKGROUND OF THE INVENTION

1. Field of the Invention

The present invention relates to a toner recovering device for electrophotographic apparatuses and a toner recovering filter for use in such a toner recovering device.

2. Description of the Related Art

The photographic recording processes of an electrophotographic apparatus represented by a printer or a copying machine include an electrically charging process, an exposing process, a developing process, a transferring process, a fixing process, a cleaning process, and an electrically discharging process. In the cleaning process out of these photographic recording processes, untransferred toner that has not been transferred onto a photosensitive body is eliminated by a mechanical cleaning device, e.g., a blade or a brush. This cleaning process is required in order to prevent drum offset caused by leaving the untransferred toner on the surface of the photosensitive body during the photographic recording process.

A large-sized high-speed electrophotographic apparatus consumes large amounts of toner per unit time, and this increases the amount of untransferred toner that remains on the surface of the photosensitive body. In order to recover the untransferred toner that has been removed by the cleaning device from the surface of the photosensitive body, a toner recovering device is generally employed. The toner recovering device includes a cyclone dust collector, a toner recovering filter, a cyclone dust collector blower, etc.

SUMMARY OF THE INVENTION

An object of the invention is to provide a toner recovering device which is simple in construction and excellent in maintainability and reliability.

To achieve the above object, there is provided a toner recovering device for an electrophotographic apparatus, which includes: a dust collector connected to a device for cleaning untransferred toner remaining on a photosensitive body; a toner recovering filter having an inlet port for introducing an air-toner mixture from the dust collector side and an exhaust port for filtering the air-toner mixture and discharging the air from which the toner has been removed; a filter mounting section for mounting the toner recovering filter; a joint mechanism having a joint and a hose member, one end of the hose member capable of being connected to the dust collector and the other end thereof being connected to the joint, the joint being disposed at the inlet port, the joint mechanism being arranged in the filter mounting section in such a manner as to be opened and closed; a detecting means for sensing that the toner recovering filter has been mounted or not onto the filter mounting section; and a pulling member for coupling the inlet port of the toner recovering filter to the joint in synchronism with an operation of mounting the toner recovering filter onto the filter mounting section.

According to the toner recovering device thus constructed, the joint is pulled toward the toner recovering filter by the pulling member in synchronism with the toner recovering filter mounting operation, so that the inlet port of the toner recovering filter can be connected to the joint through a single operation. In addition, the toner recovering filter can operate the toner recovering filter detecting switch, which in turn allows the toner recovering filter mounting condition can be checked.

The above and other objects and features of the present invention will be more apparent from the following description taken in conjunction with the accompanying drawings.

DETAILED DESCRIPTION OF THE PREFERRED EMBODIMENTS

An embodiment of the invention will now be described with reference to the drawings.

Figure 1:
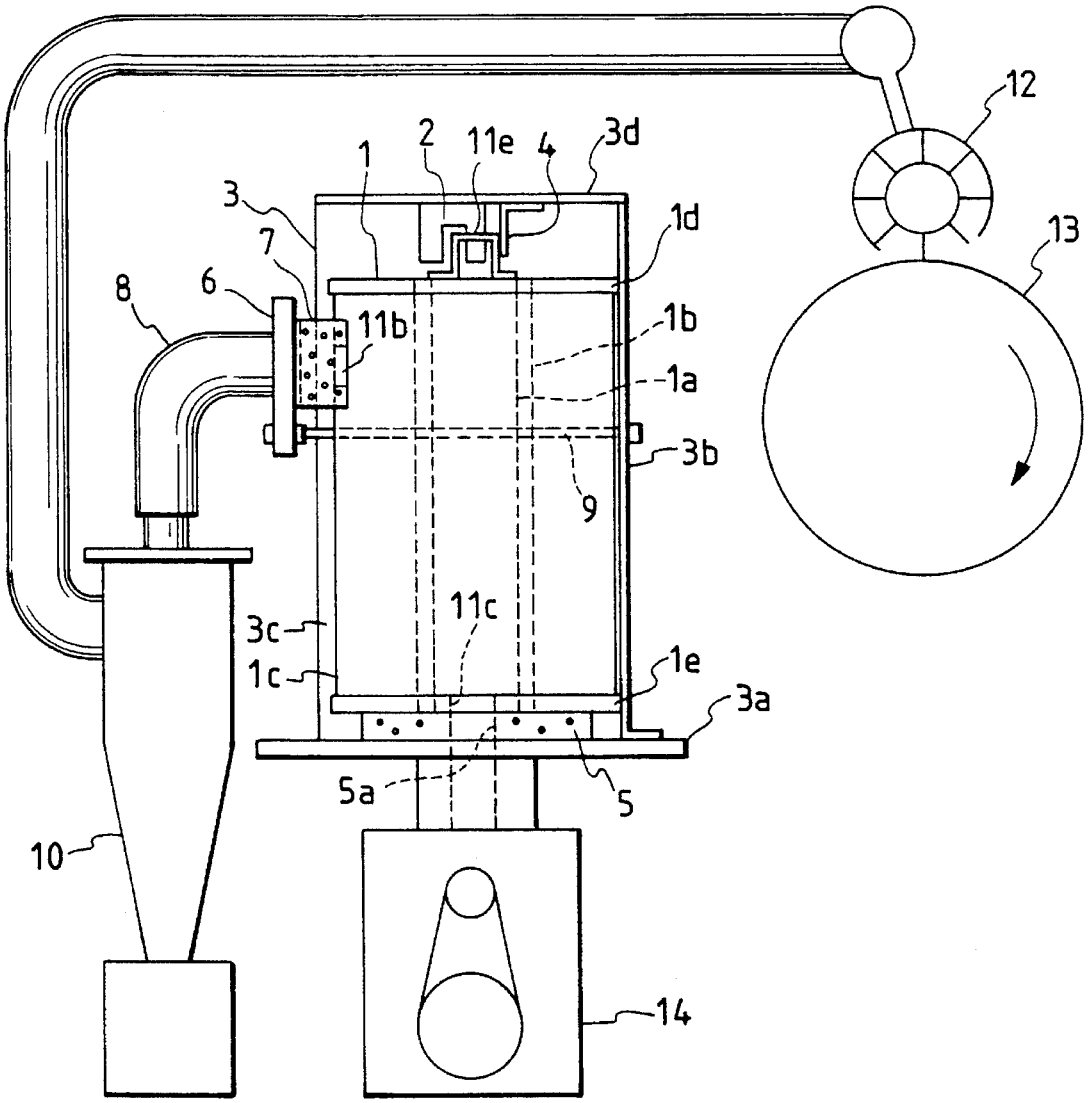
FIG. 1 is a schematic front view of a toner recovering device.
Figure 2:
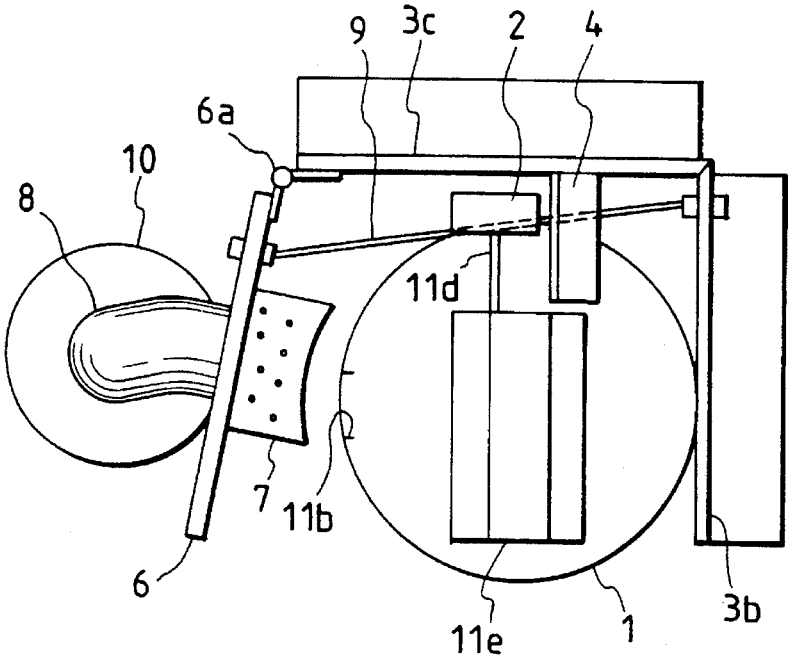
FIG. 2 is a schematic plan view showing a condition in which a toner recovering filter is mounted onto a filter mounting section.
Figure 3:
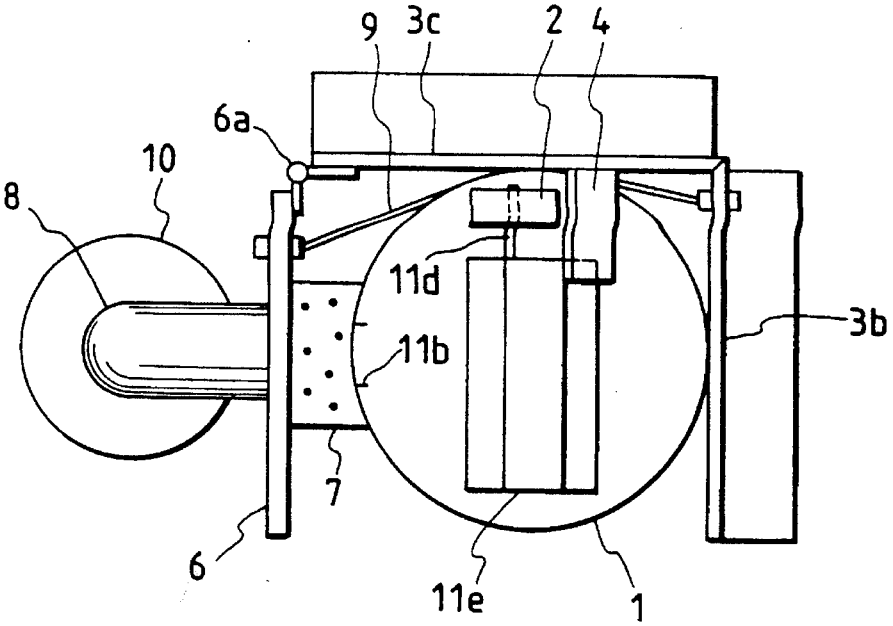
FIG. 3 is a schematic plan view showing a condition in which the toner recovering filter is mounted onto the filter mounting section.
Figure 4:
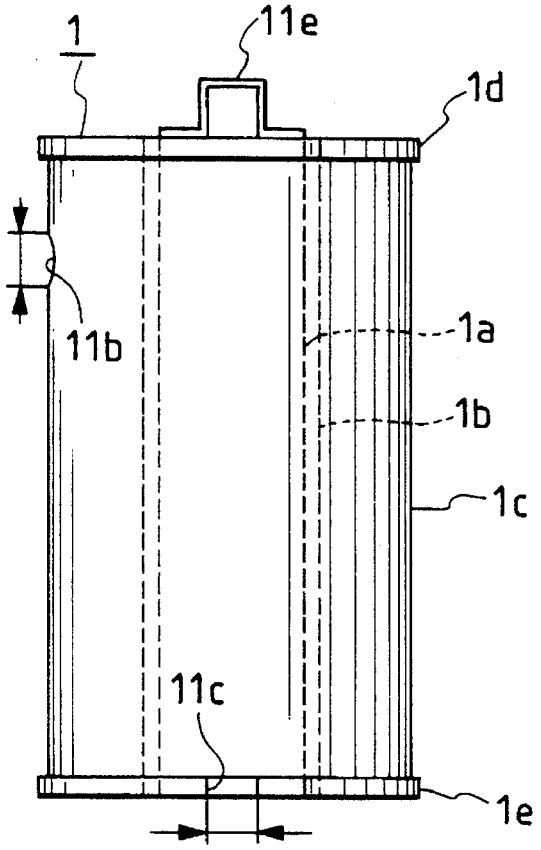
FIG. 4 is a front view of the toner recovering filter.
Figure 5:
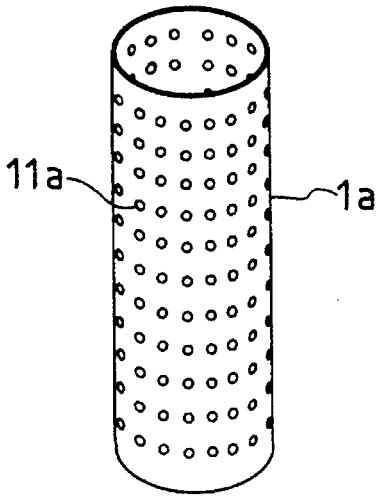
FIG. 5 is a perspective view of an inner drum.
Figure 6:
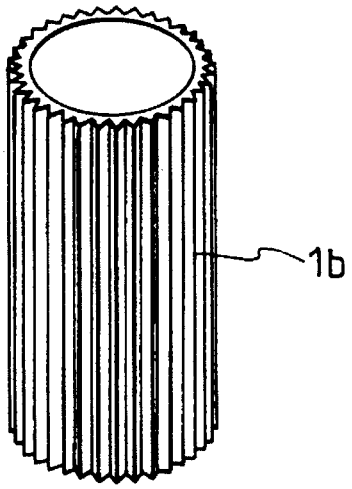
FIG. 6 is a perspective view of a filter drum.

In FIGS. 1 to 4, reference numeral 1 denotes a toner recovering filter. As shown in FIG. 4, the toner recovering filter 1 includes an inner drum 1*a*, a filter drum 1*b*, an outer drum 1*c*, an upper lid 1*d*, and a lower lid 1*e*. The inner drum 1*a* is made of, e.g., a coated steel plate into a hollow circular cylinder as shown in FIG. 5, and has through holes 11*a* whose diameter is about 5 mm over the circumferential surface thereof. The filter drum 1*b* is made of an air-permeable filter material into a hollow circular cylinder as shown in FIG. 6, and has the diameter thereof made larger than the outer diameter of the inner drum la so that the filter drum 1*b* encloses the inner drum 1*a* therein as shown in FIG. 1. The outer drum 1*c* is made of, e.g., a coated steel plate into a hollow circular cylinder, and has an inlet port 11*b* in the circumferential surface thereof. The outer drum 1*c* has the diameter thereof made larger than the outer diameter of the filter drum 1*b* so that the outer drum 1*c* encloses the filter drum 1*b* therein as shown in FIG. 1. The respective drums 1*a*, 1*b*, 1*c* are disposed substantially concentrically, and are firmly interposed between the upper lid 1*d* and the lower lid 1*e* by adhesion or the like.

In the middle portion of the lower lid 1*e* is an exhaust port which is smaller in dimension than the inner diameter of the inner drum 1*a*. Further, a strip to be detected 11*d* is disposed on the upper surface of the upper lid 1*d* through a guide member 11*e*. The strip to be detected 11*d* is designed to operate a toner recovering filter detecting switch 2 that is arranged on the side of an electrophotographic apparatus main body. As a result of this construction, the toner recovering filter 1 is closed except at the inlet port 11*b* and the exhaust port 11*c*. If the toner recovering capacity of the toner recovering filter 1 is impaired, the whole body of the toner recovering filter 1 is replaced with a new toner recovering filter while removed from the electrophotographic apparatus main body. The guide member 11*e* projects upward, and guides the mounting of the toner recovering filter 1 while coming in contact with a guide member 4 arranged on the side of the electrophotographic apparatus main body when the toner recovering filter 1 is to be mounted.

The filter mounting section 3 includes a bottom plate 3*a*, side plates 3*b*, 3*c*, and an upper plate 3*d*. Substantially in the middle of the bottom plate 3*a*, i.e., at a position corresponding to the exhaust port 11*c* of the toner recovering filter 1 is a seal member 5 for closing the periphery of the exhaust port 11*c*. It may be noted that a through hole 5*a* is formed in the middle of the seal member 5 so that the exhaust port 11*c* of the toner recovering filter 1 is caused to communicate with a blower 14. The guide member 4 and the filter detecting switch 2 are fixed to the upper plate 3*d*. A joint 6 is attached to an end portion of the side plate 3*c* through a hinge 6*a* so that the joint 6 can be opened and closed.

A seal member 7 and a hose 8 are provided on the joint 6. The seal member 7 closes the periphery of the exhaust port 11*b* of the toner recovering filter 1. The hose 8 is flexible and connected to a cyclone 10. It may be noted that the cyclone 10 is connected to a cleaning device 12 through piping. The cleaning device 12 cleans untransferred toner that remains on a surface of a photosensitive drum 13. It may also be noted that a pulling member, e.g., a wire 9 is installed between the joint 6 and the side plate 3*b*.

When the toner recovering filter 1 that is mounted as shown in FIG. 3, the joint 6 is opened, and then the toner recovering filter 1 is pulled out along the guide members 11*e* and 4. When a new toner recovering filter is mounted, the new toner recovering filter 1 is placed on the exhaust port seal member 5 and is then pushed in while slid along the guide members 11*e* and 4.

As the toner recovering filter 1 is further pushed in, the toner recovering filter 1 comes in contact with the wire 9. Since no tension is applied to the wire 9 when the joint 6 is opened, the wire 9 does not pull the joint 6 toward the toner recovering filter 1. However, as the toner recovering filter 1 is pushed into the depth, tension is applied to the wire 9, causing the joint 6 to be closed while pulled by the wire 9. The mounting of the toner recovering filter 1 is completed this way. As shown in FIG. 3, the toner recovering device is designed so that the filter detecting switch 2 is operated by the strip to be detected 11*d* under the conditions that the toner recovering filter 1 has been pushed into the depth and that the wire 9 is therefore bent. If the joint 6 is not closed normally, a signal indicating that the filter has not been mounted is generated based on an output of the filter detecting switch 2. The filter detecting switch 2 can be used also as a joint opening/closing detecting switch.

According to the invention, a toner recovering device whose construction is simple and which has excellent maintainability and reliability as well as a toner recovering filter suitable for such toner recovering device can be provided.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A toner recovering device for an electrophotographic apparatus, comprising:

means for cleaning untransferred toner remaining on a photosensitive body;

a dust collector connected to said cleaning means, for collecting the untransferred toner through said cleaning means;

a toner recovering filter for filtering an air-toner mixture containing the untransferred toner from said dust collector, said toner recovery filter having an inlet port for introducing the air-toner mixture from said dust collector and an exhaust port for discharging the air from which the toner has been removed;

a filter mounting section for mounting said toner recovering filter;

a joint mechanism having a joint and a hose member, one end of the hose member being connected to said dust collector and an other end of the hose member being connected to said joint, said joint being disposed at the inlet port of said toner recovering filter, said joint mechanism being arranged in the filter mounting section so as to be opened and closed;

detector means for sensing that said toner recovering filter has been mounted or not onto said filter mounting section; and a pulling member for coupling the inlet port of said toner recovering filter to said joint in cooperation with an operation of mounting said toner recovering filter onto said filter mounting section.

2. A toner recovering device as claimed in claim 1, wherein said toner recovering filter comprises: a hollow cylindrical inner drum having a plurality of through holes over a circumferential surface thereof;

a hollow cylindrical filter drum enclosing said inner drum therein;

a hollow cylindrical outer drum having the inlet port of said toner recovery filter in a circumferential surface thereof and enclosing said filter drum therein;

a lower lid holding said inner drum, said filter drum and said outer drum substantially concentrically and having the exhaust port of said toner recovery filter in a middle portion thereof, the exhaust port having a dimension smaller than an inner diameter of said inner drum; and an upper lid holding said inner drum, said filter drum and said outer drum substantially concentrically and having on an upper surface thereof a member to be detected; and wherein said detector means comprises a member to be detected which is provided on an upper surface of said upper lid holding, and a toner recoverying filter detecting switch arranged on a side of an electrophotographic apparatus main body, said member to be detected operating said toner recovering filter detecting switch.

3. A toner recovering device as claimed in claim 2, wherein said detector means generates a signal indicating that said toner recovering filter has not been mounted onto said filter mounting section according to an output from said filter detecting switch.

4. A toner recovering filter, comprising:

a hollow cylindrical inner drum having a plurality of through holes over a circumferential surface thereof;

a hollow cylindrical filter drum enclosing said inner drum therein;

a hollow cylindrical outer drum having an inlet port in a circumferential surface thereof and enclosing said filter drum therein;

a lower lid holding said inner drum, said filter drum and said outer drum substantially concentrically and having an exhaust port in a middle portion thereof, the exhaust port having a dimension smaller than an inner diameter of said inner drum; and an upper lid holding said inner drum, said filter drum and said outer drum substantially concentrically and having on an upper surface thereof a member to be detected, the member to be detected operating a toner recovering filter detecting switch arranged on a side of an electrophotographic apparatus main body.

* * * * *